US005215148A

United States Patent [19]

Ricles

[11] Patent Number: 5,215,148

[45] Date of Patent: Jun. 1, 1993

[54] SUBSURFACE WELL PRESSURE ACTUATED AND FIRED APPARATUS

[75] Inventor: Thomas D. Ricles, Grand Prairie, Tex.

[73] Assignee: Dresser Industries, Inc., Dallas, Tex.

[21] Appl. No.: 698,720

[22] Filed: May 10, 1991

[51] Int. Cl.[5] ..... E21B 43/1185

[52] U.S. Cl. ..... 166/298; 175/4.56; 175/297

[58] Field of Search ..... 166/297, 298, 321; 175/4.56, 296, 297

[56] References Cited

U.S. PATENT DOCUMENTS 2,304,408 12/1942 Holifield .
3,189,094 6/1965 Hyde .
4,484,639 11/1984 Ayers .
4,544,034 10/1985 George ..... 166/55.1 X
4,606,409 8/1986 Peterson et al. .
4,616,718 10/1986 Gambertoglio .
4,650,010 3/1987 George et al. ..... 166/55.1 X
4,690,227 9/1987 George et al. ..... 175/4.56
4,762,179 8/1988 Wesson et al. .
4,770,246 9/1988 Ward .
4,830,120 5/1989 Stout ..... 166/298 X
4,886,127 12/1989 Ricles et al. .

*Primary Examiner*—Thuy M. Bui
*Assistant Examiner*—Roger J. Schoeppel
*Attorney, Agent, or Firm*—Jones, Day, Reavis & Pogue

[57] ABSTRACT

A firing apparatus for use with a tubing-conveyed perforating apparatus is disclosed. Wellbore pressure applies an upward force to a first piston connected by a shearable coupling to a firing piston. At a predetermined pressure the coupling shears, allowing the first piston to move upward. The first piston moves upward until the firing piston is in fluid communication with the pressure. The firing piston is forced downward by the pressure, firing the perforating apparatus.

10 Claims, 1 Drawing Sheet

SUBSURFACE WELL PRESSURE ACTUATED AND FIRED APPARATUS

FIELD OF THE INVENTION

This invention relates generally to a subsurface well apparatus for firing a borehold perforating apparatus. In particular, the invention relates to a pressure actuated and fired apparatus.

BACKGROUND OF THE INVENTION

It is common to complete oil and gas wells by perforating the well casing and surrounding producing formation. Typically a perforating apparatus is attached to the end of a tubing string and lowered adjacent the producing formation. The perforating apparatus then is fired, and the well produces through the tubing string. One example of a tubing string-conveyed perforating apparatus can be found in U.S. Pat. No. 4,523,643, issued to McGlothen and assigned to the assignee of the present invention, which is incorporated herein by reference.

The perforating apparatus typically has been fired electronically or by dropping a detonating bar down the tubing string to strike a firing head. Neither method has been entirely satisfactory. Electronic firing systems require care in connecting and running the system down the tubing. Electronic firing systems also can be activated accidentally by stray electrical currents and can be short-circuited by moisture. A perforating apparatus for use with a detonating bar contains a charge designed to explode when struck, making such a perforating apparatus dangerous to handle. Further, it may not be possible to use a detonating bar in a highly deviated well.

Various pressure firing systems have been developed to overcome some of the deficiencies of the electronic and bar firing systems. In one early embodiment a fluid or gas pressure is applied through the tubing string to a pressure firing system. The pressure forces a firing pin into contact with a detonator, thus firing the perforating apparatus. One type of pressure firing system is illustrated in U.S. Pat. No. 2,304,408, issued to Holifiled. Pressure firing systems of this type are also dangerous to handle because they may fire upon the application of any unintended pressure.

Firing systems have been developed recently that are actuated by directed pressure, minimizing the risk of accidental firing. In these firing systems pressurized fluid in the tubing is directed inside the firing apparatus where it works against a piston. Sufficient force caused by the fluid pressure against the piston shears a coupling and in turn releases a spring-loaded firing pin. This system is exemplified in U.S. Pat. No. 4,770,246, issued to Ward, and U.S. Pat. No. 4,886,127, issued to Ricles et al., both assigned to the assignee of the present invention, which are incorporated herein by reference. This type of system functions well but has the added complexity of combining the pressure actuated mechanism with the spring-loaded firing mechanism.

These and other disadvantages are overcome by the present invention. The present invention discloses a firing apparatus in which the wellbore pressure serves both to actuate the apparatus and to fire the perforating apparatus.

SUMMARY OF THE INVENTION

In the preferred embodiment of the invention, a firing apparatus is provided for use with a tubing-conveyed perforating apparatus. The firing apparatus is connected to a cable or tubing, i.e. coil tubing, and lowered into engagement with a perforating apparatus set within a well. The cable is removed and pressure is applied to the tubing annulus. The pressure applies an upward force on a first piston connected by a coupling to a firing piston. At a predetermined pressure the coupling shears, allowing the first piston to move upward. The first piston moves upward holding the firing piston in its position until the firing piston is in fluid communication with the pressure. The firing piston is forced downward by the pressure, firing the perforating apparatus.

DETAILED DESCRIPTION OF THE PREFERRED EMBODIMENT

Figure 1A:
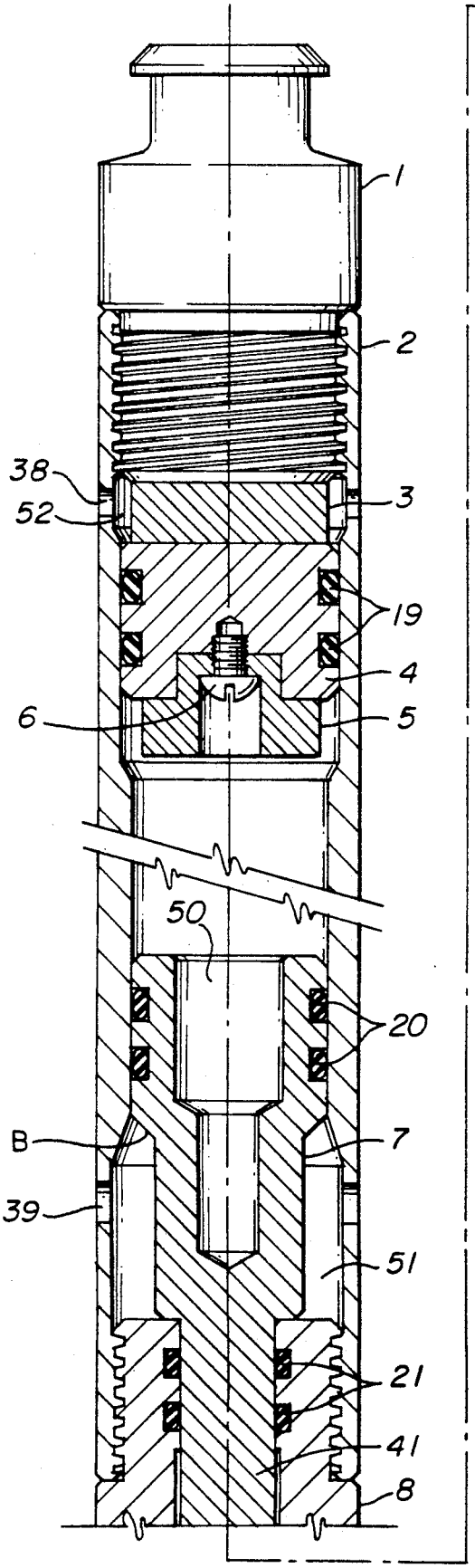
FIGS. 1A and 1B are longitudinal views in cross section of the pressure actuated and fired apparatus of the present invention.
Figure 1B:
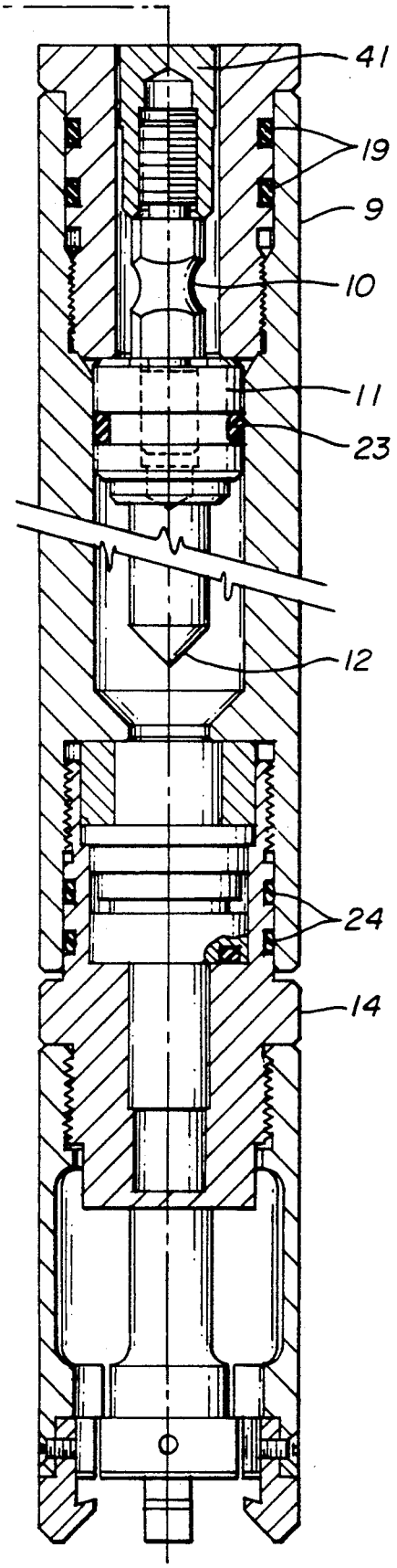

Referring to the drawings, the upper portion of the firing apparatus of the present invention is shown generally in FIG. 1A and the lower portion is shown generally in FIG. 1B. The terms "upper" and "lower" refer to the orientation of the firing apparatus in use.

The outer construction of the firing apparatus will be described first. Referring to FIG. 1A, connector sub 1 is at the top of the firing apparatus. Connector sub 1 has an upper grapple flange portion A adapted to be releasably connected to a cable (not shown) and is threadably attached to the upper end of upper housing 2. The lower end of upper housing 2 in turn is threadably attached to the upper end of coupling sub 8. Referring now to FIG. 1B, the lower end of coupling sub 8 is threadably attached to the upper end of lower housing 9. Seals 19 provide a fluid seal between coupling sub 8 and lower housing 9. The lower end of lower housing 9 is in turn threadably attached to the firing head assembly, shown generally at 14. Firing head assembly 14 is of the type disclosed in U.S. Pat. No. 4,484,639, issued to Ayers and assigned to the assignee of the present invention, which is incorporated herein by reference. Seals 24 provide a fluid seal between lower housing 9 and firing head assembly 14.

The inner construction of the firing apparatus will now be described. Returning to FIG. 1A, damping pad 3 is coupled to connector sub 1 inside of upper housing 2. Impact pad 5 is retained by screw 6 to damping piston 4. Impact pad 5 and damping pad 3 are made of suitable shock absorbing material such as rubber. Preferably impact pad 5 is made of an elastomer having a 60–70 durometer hardness. Seal members 19 provide a fluid seal between damping piston 4 and upper housing 2. Damping chamber 52 is formed between damping pad 3, upper housing 2, and damping piston 4. Damping chamber 52 is in fluid communication with the tubing annulus (not shown) by ports 38.

Actuating piston 7 is slidably disposed within upper housing 2. In the absence of external pressure, actuating piston 7 by its own weight contacts the upper end of coupling sub 8. Actuating piston 7 has a first portion sized to fit within upper housing 2 such that the outer diameter of the first portion of actuating piston 7 is substantially the same as the inner diameter of upper housing 2. Seals 20 provide a fluid seal between the first portion of actuating piston 7 and upper housing 2. Actuating piston 7 has a second portion sized to fit within upper housing 2 such that the outer diameter of the second portion of actuating piston 7 is smaller than the inner diameter of upper housing 2 to form pressurizing chamber 51. Pressurizing chamber 51 is in fluid communication with the tubing annulus (not shown) by ports 39.

The upper end of actuating piston 7 includes open cylindrical cavity 50, having a slightly smaller diameter than impact pad 5. Cavity 50 serves to reduce the mass of actuating piston 7 and thus reduces the upward momentum of the piston during actuation. The reduced mass of actuating piston 7 also serves to reduce the downward momentum of actuating piston 7 and rod 41 if the apparatus were activated prematurely while being lowered into the wellbore.

Rod 41 is integral with the lower end of actuating piston 7. Rod 41 is slidably disposed within the bore of coupling sub 8. Seals 21 provide a fluid seal between rod 41 and coupling sub 8.

Referring now to FIG. 1B, shearable coupling 10 is threadably attached to both the lower end of rod 41 and the upper end of firing piston assembly 11. Firing piston assembly 11 is slidably disposed within lower housing 9, such that the diameter of firing piston assembly 11 is substantially the same as the inner diameter of lower housing 9. Seal 23 provides a fluid seal between firing piston assembly 11 and lower housing 9. The diameter of firing piston assembly 11 is greater than the bore diameter of coupling sub 8 so that firing piston assembly 11 cannot travel through the bore.

In operation a tubing-conveyed perforating apparatus is lowered into a well, and a packer is set to isolate the zone to be perforated. The firing apparatus of the present invention is connected to a cable, preferably a nonelectrical slick line, at connector sub 1 by means of a fishing tool common in the art. The firing apparatus may be connected to coil tubing, well known in the art, when used in horizontal wells. The firing apparatus is lowered through the tubing string until the grapple sub of the firing apparatus engages the perforating apparatus. This procedure is described more fully in the detailed description in previously mentioned U.S. Pat. No. 4,770,246. When the firing apparatus and the perforating apparatus are engaged the cable is tugged, releasing the fishing tool from connector sub 1. The cable or tubing then is removed from the well.

The firing apparatus is actuated by pressurizing the tubing string. The tubing string is pressurized by pumping fluid or gas into the tubing string. The pressure increase causes a corresponding pressure increase in pressurizing chamber 51 through port 39. The pressure in pressurizing chamber 51 exerts an upward force on the sloping surface B between the first and second portions of actuating piston 7. However, actuating piston 7 initially is prevented from moving up inside upper housing 2 because of the contact between coupling sub 8 and firing piston assembly 11.

Sufficient pressure will cause the upward force exerted on actuating piston 7 to exceed the tensile strength of coupling 10. The tensile strength of coupling 10 is selected in view of well conditions. At such a pressure, coupling 10 will shear and uncouple rod 41 from firing piston assembly 11. Actuating piston 7 and integral rod 41 will be forced by the pressure within pressurizing chamber 51 up through upper housing 2 into contact with impact pad 5.

Pressure within the tubing string also will create corresponding pressure in damping chamber 52 through port 38. The pressure in damping chamber 52 will force damping piston 4 downward into the inwardly sloping surface of the interior of upper housing 2. Therefore, when upwardly moving actuating piston 7 contacts impact pad 5 the force behind the piston is dampened initially by the impact pad 5 itself, then by the pressurized fluid or gas in damping chamber 52, and finally by damping pad 3. The force is dampened to prevent damage to the upper firing assembly.

As actuating piston 7 and integral rod 41 travel upward seals 21 and 23 create a partial vacuum in the bore of coupling sub 8 behind the exiting rod. The partial vacuum prevents firing piston assembly 11 from sliding down in lower housing 9. Before actuating piston 7 contacts impact pad 5 the rising lower end of rod 41 clears seals 21. This places the bore of coupling sub 8 and firing piston assembly 11 in fluid communication with pressurizing chamber 51. Thus, the moment rod 41 clears seals 21 the partial vacuum disappears and in its place the pressurized fluid or gas in pressurizing chamber 51 enters the bore of coupling sub 8. The pressure in the bore rapidly forces firing piston assembly 11, down inside lower housing 9 until the firing pin or striker 12 contacts firing head assembly 14, firing the perforating apparatus below.

Once the firing operation is complete, or should the firing apparatus fail, the entire apparatus can be removed, and replaced if necessary, as described in previously mentioned U.S. Pat. No. 4,770,246.

Thus, there has been disclosed a novel pressure actuated firing assembly that utilizes only well pressure to activate it and that does not require the use of a force generating means such as a spring loaded firing mechanism. It is more simple and economical to construct than the prior art devices and is safer to operate.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. An apparatus for firing a borehole perforating apparatus, said firing apparatus comprising:

an elongated housing;

a first piston within said housing, said first piston being movable in response to a pressure;

a second piston within said housing, said second piston being movable in response to said pressure;

a striker integral with said second piston;

an elongated rod coupling said first piston and said second piston, said rod having an area with a reduced cross section that is shearable in response to said pressure on said first piston; and a pressure passageway in the housing such that said pressure directly contacts said first piston, causing said rod to shear and said first piston to move upwardly, the movement of said first piston allowing said pressure to directly contact said second piston, causing said second piston and said integral striker to move downwardly to fire said perforating apparatus.

2. Apparatus as in claim 1 further comprising means for preventing said second piston from moving downwardly to fire the perforating apparatus until the first piston has moved upwardly a sufficient distance to allow the pressure to directly contact the second piston.

3. Apparatus as in claim 2 wherein said means for preventing movement of the second piston comprises:

a first portion of the elongated rod extending from the first piston and having a first outside diameter less than the inside diameter of the housing to form a pressurizing chamber coupled to the pressure passageway and a second portion extending from the first portion and having a smaller diameter than the first portion;

a coupling subhousing connected to the elongated housing and having an inside diameter substantially identical to the second portion of the elongated rod; and seals placed between the subhousing and the second portion of the rod to prevent fluid escape from the pressurizing chamber such that pressure in the pressure passageway shearing said coupling also forces the second portion of the elongated rod to move upwardly with the first piston until the sheared coupling passes said seals to allow pressure in said pressurizing chamber to contact the second piston and move the second piston downwardly to fire the perforating apparatus.

4. In a fluid pressure actuated apparatus for firing a perforating gun disposed in a tubing string within a borehold, said apparatus having an elongated housing and comparing:

a fluid chamber in the housing;

a first piston movable only upwardly in the fluid chamber;

a second piston movable only downwardly in the tubing string;

a shearable member coupled the first and second pistons for shearing in response to fluid pressure within the tubing string;

a striker coupled to said second piston; and the shearable member enabling the fluid pressure to move the first piston upwardly after shearing and to move the second piston and the striker only in a downward direction for firing the perforating gun.

5. Apparatus as in claim 4 further including:

an orifice in said housing allowing the fluid pressure within the tubing string to enter the fluid chamber under the first piston to shear the shearable member and move the first piston upwardly; and a rod extended from the first piston in slidable engagement with the housing and forming the shearable member such that the sheared member moves into the fluid chamber as the first piston moves upwardly a predetermined distance, and the pressurized fluid in the fluid chamber is permitted to move the second piston downwardly and fire the perforating gun.

6. Apparatus as in claim 4 further comprising:

fluid seals engaging the rod for preventing pressurized fluid from contacting the second piston until the sheared member moves into the fluid chamber.

7. Apparatus as in claim 6 wherein sealing engagement with the rod is lost when the length of the rod extending from the first piston to the sheared member moves past the fluid seals into the fluid chamber thereby allowing pressurized fluid to contact the second piston.

8. A method of firing a perorating gun disposed in a tubing string within a borehole with an apparatus having an elongated housing comprising the steps of:

applying a pressure to the tubing string to shear a fluid-tight connection between first and second pistons; and moving the first piston and sheared connection a distance upwardly sufficient to break the fluid-tight connection and allow the applied pressure to engage the second piston and move the second piston downwardly to fire the perforating gun.

9. A method as in claim 8 further comprising the step of attaching a striker to the second piston for contacting and firing the perforating gun.

10. A method as in claim 9 further including the steps of:

connecting a shearing rod between the first and second pistons for shearing under pressure;

sealing the sharing rod with the housing in a fluid-tight relationship; and moving the second piston and firing pin downwardly only after the sheared rod has moved a sufficient distance to pass the fluid seals.

* * * * *